United States Patent [19]

Grace

[11] 4,373,834

[45] Feb. 15, 1983

[54] PORTABLE OFF SHORE WELL INSTALLATION APPARATUS

[76] Inventor: Frederick J. Grace, 11 Menemsha Way, P.O. Box 151, East Falmouth, Mass. 02536

[21] Appl. No.: 211,829

[22] Filed: Dec. 1, 1980

[51] Int. Cl.[3] ..... E02B 15/04

[52] U.S. Cl. ..... 405/60; 405/209

[58] Field of Search ..... 405/60, 209, 63–72; 210/922, 923

[56] References Cited

U.S. PATENT DOCUMENTS

| | | | |
|---|---|---|---|
| 3,230,967 | 1/1966 | Castro | 405/60 X |
| 3,548,605 | 12/1970 | Paull et al. | 405/60 |
| 3,561,220 | 2/1971 | Riester | 405/60 |
| 3,599,434 | 8/1971 | Missud | 405/60 |
| 3,653,215 | 4/1972 | Crucet | 405/60 |
| 3,664,136 | 5/1972 | Laval et al. | 405/60 |
| 3,724,662 | 4/1973 | Ortiz | 405/60 |
| 3,879,951 | 4/1975 | Mason | 405/60 |
| 4,047,390 | 9/1977 | Boyce | 405/60 X |

*Primary Examiner*—Dennis L. Taylor

*Attorney, Agent, or Firm*—Hauke and Patalidis

[57] ABSTRACT

A portable off shore well installation apparatus, particularly for off shore wells, utilizing a pollution control curtain surrounding drilling equipment between the surface of the water and a well head, such curtain comprising a submerged anchor ring having secured to the top thereof an axially extendable water impermeable sleeve secured at its lower end to the top of the submerged anchor ring, a float ring secured to the upper end of the extendable sleeve, a plurality of longitudinally spaced buoyant rings attached at suitable intervals about the periphery of the sleeve to provide uniform axial extension of the sleeve, and a fillable retriever ring secured to the lower portion of the anchor ring to facilitate installation and removal of the curtain from the well site when the retriever ring is filled with a buoyant substance.

12 Claims, 5 Drawing Figures

FIG. 3
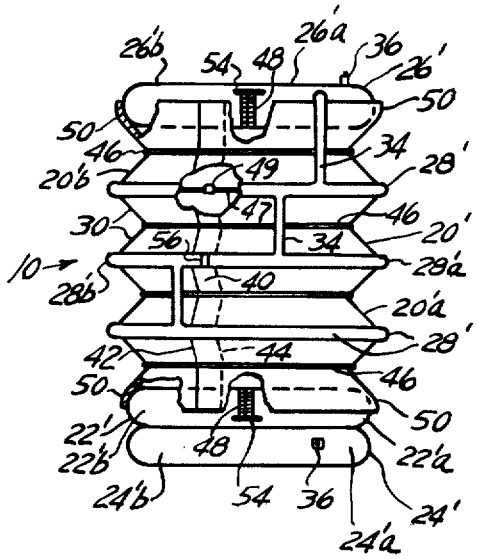
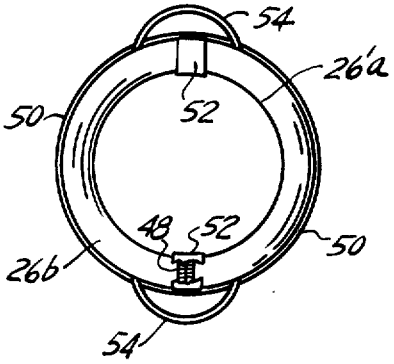
FIG. 4
FIG. 5
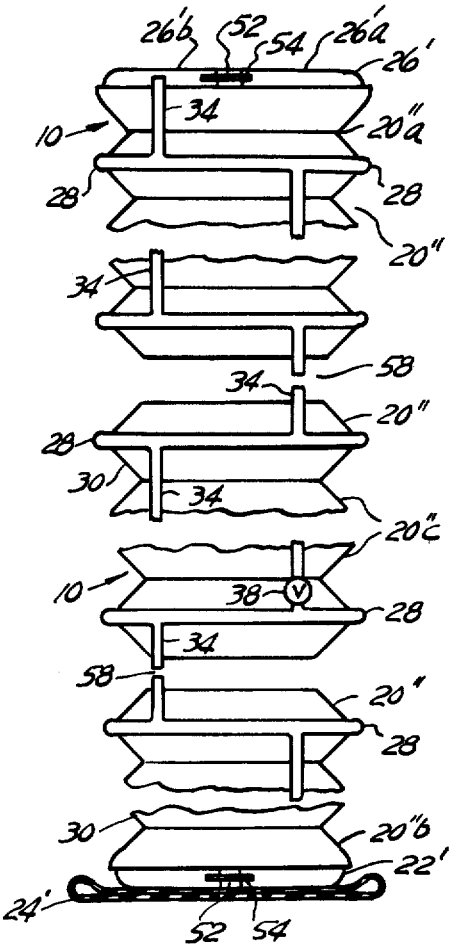

PORTABLE OFF SHORE WELL INSTALLATION APPARATUS

BACKGROUND OF THE INVENTION

1. Field of the Invention

This invention relates to a portable off shore well installation appartus for the reduction of the pollution caused by petroleum fluids seeping from underwater drilling operations. More particularly, it relates to a pollution control curtain which surrounds the underwater portion of an oil derrick or drilling platform.

2. Description of the Prior Art

Production of oil and gas from off shore locations is now commonplace in many parts of the world using equipment such as drilling platforms, oil derricks and the like. These platforms usually comprise a rectangular truss-like structure known as a jacket. Upon discovery of a field, the jacket is towed to sea, set in position and then anchored.

When the drilling is commenced, one problem that frequently arises is controlling the seepage of petroleum fluids and other contaminants from around the well head. Underwater pollution control apparatus of many designs have been developed for containing such pollutants. Some such apparatus comprise a water impermeable extension sleeve or curtain having submerged anchor means secured to the bottom thereof and a float ring secured to the top of the extension sleeve.

Typically, the contracted sleeve is set in position around the well point and then anchored. Following the installation of the sleeve, the derrick or platform is installed within the area defined by the sleeve in the manner hereinbefore described. The float ring, attached to the top of the sleeve, is then inflated to extend the sleeve toward the surface of the water such that the sleeve will surround the underwater portion of the derrick. The extension sleeve type of pollution control curtains, through which drilling equipment is operated between the surface and the well head, are not designed efficiently to control the pollution problem and are not easy to install and remove from a well site.

Prior to this invention, a float ring was the sole means for extending a pollution control sleeve or curtain through as many as several hundred feet of water. A float ring alone, however, does not provide uniform axial extension of the sleeve, and more particularly, the float ring must be very large and cumbersome in order to extend the sleeve at all.

The typical anchor means used to secure the bottom portion of the sleeve to the sea floor is either a hook-like shaped configuration, a non-buoyant weight, or a combination of the two. When hooks are used to anchor a pollution control curtain the task of imbedding the hooks into the sea floor, upon installation, and dislodging them upon removal of the curtain, is time consuming and hazardous. A curtain comprising a heavy non-buoyant anchor, as an alternative, will quickly sink to the sea floor upon installation. Consequently, the bottom portion of the curtain will be very difficult to direct onto a predesignated site about the well point. The weight of such a heavy anchor also makes removal of the curtain from the well point area toilsome.

SUMMARY OF THE INVENTION

Accordingly, it is an object of the present invention to provide an improved pollution control curtain for an off shore well installation which adequately contains pollutants resulting from the well regardless of the depth of water in which the well is located.

Another object is to provide a pollution control curtain of the character described which comprises an accordion-pleated expansible sleeve constructed of flexible impermeable material.

Another object is to provide such a curtain with an anchor ring attached to the bottom of the sleeve, such anchor ring being constructed of a flexible impermeable material which is fillable with a non-buoyant material for disposing on the bottom of a body of water about an off shore well point.

Another object is to provide such a curtain with a float ring attached to the top of the sleeve, such float ring being constructed of a flexible impermeable material which is fillable with a buoyant substance for extending the sleeve toward the surface of the water such that the sleeve surrounds the underwater portion between the surface and the well heat, through which drilling equipment is operated.

Another object is to provide such a curtain with a plurality of longitudinally spaced buoyant rings attached at suitable intervals about the periphery of the sleeve, each such buoyant ring being constructed of a flexible impermeable material which is fillable with a buoyant substance for providing uniform axial extension of the sleeve and, more particularly, for assisting the float ring extend the sleeve toward the surface of the water.

Another object is to provide such a curtain with a retriever ring attached to the bottom portion of the anchor ring, such retriever ring being constructed of a flexible impermeable material which is fillable with a buoyant substance for facilitating installation and removal of the curtain when the retriever ring is filled.

Another object is to provide such a curtain with interconnecting individual sections which can be compactly stored and quickly assembled for immediate use.

These and other objects and advantages of the present invention will become apparent to those skilled in the art when the following description of the best mode contemplated for practicing the invention is read in conjunction with the accompanying drawing wherein like reference numerals refer to like or equivalent parts, and in which:

BRIEF DESCRIPTION OF THE DRAWING

FIG. 3 is a side elevation view substantially similar to FIG. 1 with modifications and external portions cut away to expose a second form of the apparatus according to the invention;

FIG. 4 is a top plan view of the floating top member of the apparatus of FIG. 3; and FIG. 5 is a side elevation view substantially similar to FIGS. 1 and 3 with further modifications showing a third form of the apparatus according to the invention.

DETAILED DESCRIPTION OF THE PREFERRED EMBODIMENTS

Figure 1:
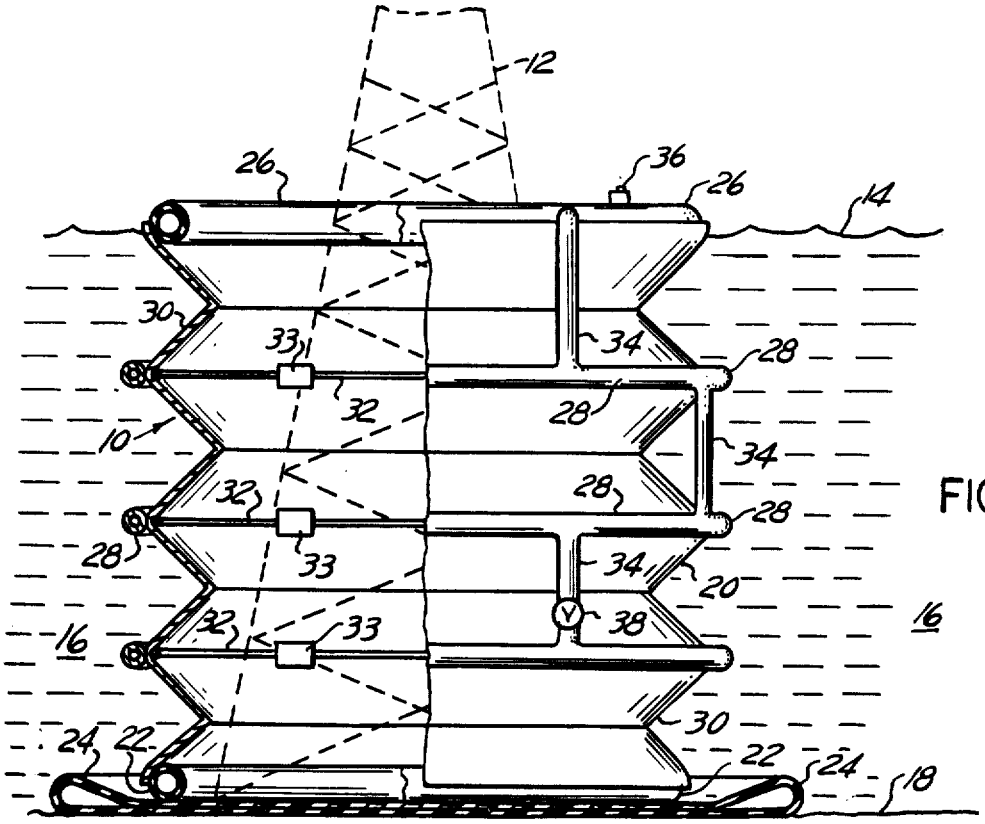
FIG. 1 is a side elevation view of a fully extended portable well installation apparatus surrounding drilling equipment about an off shore well point, said apparatus having an external portion cut away to expose the internal structure of the apparatus according to the invention.

Referring now to the drawing, and more particularly to FIG. 1, there is shown a portable well installation apparatus embodying the principles of the present invention. The portable well installation apparatus illustrated utilizes a pollution control curtain 10 surrounding drilling equipment 12 between the surface 14 of a body of water 16, such as a sea for example, and the ground 18 about a well head, not shown. Contaminants, such as oil, seeping from the well head rise to the surface of the water within the area defined by the control curtain 10. At the surface, the contaminants are confined to the area defined by the floating top portion of the control curtain from which they can be collected. The curtain 10 comprises an axially extendable sleeve member 20 constructed preferably of a flexible impermeable material, such as a vulcanized rubber fabric having, for example, reinforcing cords of nylon, polyester or rayon.

The curtain 10 further comprises an anchor ring 22 attached at its upper portion to the bottom end of the sleeve 20, a retriever ring 24 attached to the lower portion of the anchor ring 22, a float ring 26 attached to the top end of the sleeve 20, and a plurality of longitudinally spaced buoyant rings 28 attached at suitable intervals, about the periphery of the sleeve member 20, as shown in the drawing.

Figure 2:
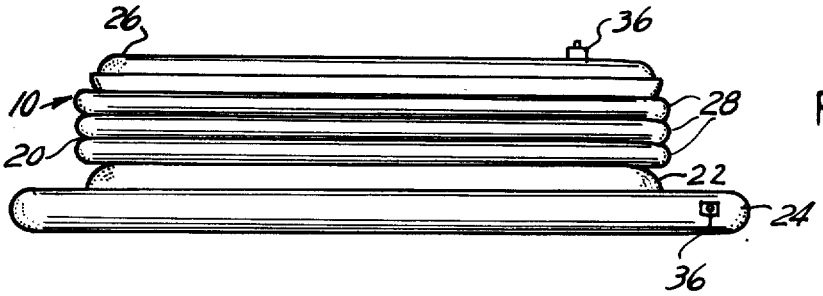
FIG. 2 is a side view of a contracted portable well installation apparatus according to the invention.

The sleeve member 20 is preferably a tubular structure having accordion-like pleats 30 so that the curtain 10 can be collapsed for storage, FIG. 2, and quickly extended for immediate use. A plurality of longitudinally spaced rigid support rings 32, made of a rigid material, such as steel or aluminum for example, are laterally attached by gusseting 33 or other means to the inside wall of the sleeve member 20 to provide sufficient rigidity to maintain the circular configuration of the sleeve member.

The anchor ring 22, attached by cement, heat seal or the like to the bottom end of the sleeve 20, is constructed of a flexible impermeable material, such as vulcanized rubber, for example, which is fillable with any non-buoyant substance that, preferably, will not cause the anchor ring to become rigid. The primary function of the anchor ring is to submerge the curtain 10 and secure the bottom end of the sleeve member 20 to the ground 18 about a well head. The flexible annular structure of the anchor ring 22 is formable to the contour of the ground 18 to prevent well contaminants from escaping from underneath the curtain 10. The anchor ring also provides uniform weight distribution of the sleeve's submerged lower end to prevent accidental dislocation of the curtain from about the well head when there is a strong current of water.

Another advantage of the anchor ring 22 of the inventin is that installation and removal of the portable curtain 10 from about the well site is relatively easy for the reason that weight, not hooks, is the means for submerging and anchoring the curtain to the ground. Also, because the appropriate non-buoyant substance, including sand or the like, placed in the anchor ring 22 is removable or extractable from the anchor ring 22, the weight and bulk of the curtain 10 is considerably reduced for storage.

Attached by cement or other means to the bottom portion of the anchor ring 22 is the retriever ring 24. The retriever ring is constructed of a flexible impermeable material which is fillable or inflatable with a buoyant substance such as air or the like through a valve 36, as shown at FIG. 2, for example. When inflated, the retriever ring 24 facilitates installation and removal of the curtain 10 from about the well site by counteracting or offsetting the weight of the anchor ring 22. During installation of the curtain, for example, the bottom end of the sleeve 20 is moe easily positioned about the well head when the retriever ring 24 is at least partly inflated. The properly positioned curtain is then anchored by deflating the retriever ring, as shown in FIG. 1. The retriever ring 24 is inflated again only when it becomes necessary or desirable to relocate or remove the curtain 10 from the well site.

Once the curtain 10 is anchored in position, the sleeve member 20 is ready to be extended to the surface 14 of the water 16. The float ring 26 and the plurality of buoyant rings 28 lift and extend the sleeve member 20 in such a manner.

The float ring 26 and the buoyant rings 28 are each constructed of a flexible water impermeable material, such as, for example, vulcanized rubber, which is fillable or inflatable with air or any other buoyant substance suitable for such purposes. The sleeve 20 is lifted or extended primarily by the float ring 26 attached to the top of the sleeve and secondarily by the longitudinally spaced buoyant rings 28 attached about the periphery of the sleeve at suitable intervals when all such rings are filled or inflated. The principal function of the buoyant rings 28 is to uniformly lift and extend the pleated portions 30 of the sleeve member 20 toward the surface of the water 16, FIG. 1, and to prevent such pleated portions from sagging.

The sleeve member 20 can be extended when the curtain 10 is anchored by filling or inflating the float ring 26 and the buoyant rings 28 individually. It is preferable, however, to provide the rings 26–28 with a plurality of interconnecting flexible lines 34 which place the interiors of all the rings in communication with each other. By this arrangement, the float ring 26 and the buoyant rings 28 are inflatable and deflatable through a single valve 36 preferably located on the float ring 26, as shown in FIG. 1. In addition, each line 34 is preferably provided with appropriate check valve means 38 to prevent deflation of all of the rings 26–28 in the event that one such ring develops a leak while the curtain is extended.

The individual members of the curtain 10 that are described herein are either fixedly or removably joined together. For example, the float ring member 26 and the sleeve member 20 may be fixedly joined together by cement bonding, heat welding, or any other suitable means as hereinbefore stated. Alternatively, those and other members may be removably joined by marine-type zippers, nuts and bolts, clamps, and the like.

The curtain 10 shown in FIGS. 1 and 2 illustrates one form of portable well installation apparatus according to the present invention. The members described and identified therein by the reference numerals 20 through 34 each have the character of a unit, not divided or segmented.

A second form of portable well installation apparatus is shown in FIGS. 3 and 4. The second form of portable well installation apparatus is substantially similar to the first form but, as shown in FIGS. 3 and 4, the curtain 10 of the second form of apparatus comprises of members having a plurality of interconnecting individual segments. Such segmented members in FIGS. 3 and 4 are indicated by reference numeals which correspond with the reference numerals indicating substantially similar non-segmented members in FIGS. 1 and 2 except that the segmented members in FIGS. 3 and 4 are indicated by reference numerals having a prime.

Referring now to FIG. 3, the sleeve member 20' has at least two interconnecting individual segments 20'*a* and 20'*b* which interconnect at two or more longitudinal seams 40. The seam 40, shown in the drawing, is an example of a seam wherein a portion of the sleeve segment 20'*a* overlaps a portion of the sleeve segment 20'*b*. The overlapping edge of the sleeve segment 20'*a* is indicated by a longitudinal line 42 and the overlapping edge of the sleeve segment 20'*b* is indicated by a hidden or broken line 44. The overlapping portions of the respective sleeve segments may be either fixedly or removably joined together in an appropriate manner hereinbefore described or longitudinally spaced bands 46 constructed of steel, aluminum or the like may be disposed about the outer periphery of the sleeve member 20' for holding the segments 20'*a* and 20'*b* together. It should be noted that if the bands 46 are used to join the sleeve segments together, the overlapping portions need not be sealably attached to prevent pressure leakage of contaminants from the interior of the curtain to the ambient. Such leakage can readily be prevented by pumping water from the interior of the curtain to lower the level, as needed, to maintain a lower hydrostatic pressure in the interior of the curtain than on the exterior.

A plurality of longitudinally spaced rigid support ring segments 47 are attached by nuts and bolts or other means to the inside wall of each segment of the sleeve member 20'. Each support ring segment 47 is a semi-annularly shaped member having its two ends each disposed proximate a point along one of the two longitudinal edges 42–44 of a segment of the sleeve member 20'. Each end of a support ring segment 47 includes means, such as clamps 49, and nuts and bolts for example, for connecting such end to the end of a corresponding support ring segment in another sleeve segment. The interconnected support ring segments 47 form rigid annular members which are substantially similar to the support rings 32 illustrated in FIG. 1, and which provide sufficient rigidity to maintain the circular configuration of the interconnected segments of the sleeve member 20'.

An anchor ring 22', attached to the bottom end of the sleeve member 20' by clamps or other means, is substantially similar to the anchor ring 22 hereinbefore described. Both anchor rings 22 and 22' perform the same function in the same manner. Unlike the anchor ring 22, however, the anchor ring 22' has at least two interconnecting individual segments 22'*a* and 22'*b* which are fixedly or removably joined together by any of the appropriate means previously disclosed. For illustrative purposes, a marine-like zipper 48 is shown in a cutaway portion in FIG. 3 as an example of means for joining the anchor ring segments 22'*a* and 22'*b* together. It is important to note that, regardless of the means used to join the anchor ring segments, any opening or gap between the abutting ends of such segments are preferably closed off so that contaminants within the curtain cannot escape therefrom. The bottom end of the sleeve 20' may overlap the anchor 22' such as to envelope or form a lip 50 covering a gap between the anchor's segments. Alternatively or in addition thereto, a patch of water impermeable material 52, such as that shown in FIG. 5 may be attached by cement or other means to or about the abutting ends of the anchor ring segments to prevent leakage.

A retriever ring 24' and a float ring 26', FIGS. 3 and 4, are substantially similar to and perform the same function in the same manner as their respective counterparts 24 and 26 in FIG. 1. The retriever ring 24', attached to the bottom portion of the anchor ring 22', by clamps or the like and the float ring 26', attached in a like manner to the top end of the sleeve member 20', each have at least two interconnecting segments 24'*a*–24'*b* and 26'*a*–26'*b* which are joined together by marine-like zippers 48 or other appropriate means. The segments of each ring 24' and 26' preferably have cross-over flexible lines 54 placing the interiors of such segments in communication with each other to facilitate inflation and deflation of the rings by a single valve 36 attached to one segment of each said ring. The flexible lines 54 are preferably provided with appropriate valve means such as that shown at 38 to prevent deflation of all the sections of a particular ring 24' or 26' in the event one section develops a leak. In addition, any opening or gap etween the abutting ends of the float ring sections 26'*a* and 26'*b* are preferably sealed off so that contaminants at the surface of the water 14 which are confined to the area defined by the float ring 26' cannot escape into the ambient water. The top end of the sleeve 20' may overlap the float ring such as to enclose or form a lip 50 covering a gap. Alternatively, or in addition thereto, a patch of water impermeable material 52 may be attached by cement or other means to or about the abutting ends of the float ring sections to prevent contaminants from escaping therefrom.

The plurality of buoyant rings 28, attached about the periphery of the sleeve member 20, are easily adaptable for attachment about the sleeve member 20'. For example, FIG. 3 shows a second form of buoyant rings 28', having at least two segments 28'*a* and 28'*b* which interconnect at a point 56 proximate the seam 40 of the sleeve member 20'. Clamps or other appropriate means are used to connect the buoyant ring segments together.

Referring to FIG. 5, there is shown a further modification of a portable well installation apparatus embodying the principles of the present invention. The third form of portable well installation apparatus is substantially similar to the first and second forms. The third form, however, comprises a curtain 10 having a sleeve member 20'' with at least a top lateral segment 20''*a* interconnected with a base or bottom lateral segment 20''*b*. In FIG. 5, the sleeve segments 20''*a* and 20''*b* are disconnected from each other so that at least one intermediate segment 20''*c* can be joined at its top end with the segment 20''*a* and at its bottom end with segment 20''*b* to form a sleeve member 20'' with additional length for use in deep water. The lateral segments of the sleeve member 20'' are interconnected or joined together by nuts and bolts, clamps, marine-like zippers, heat seals, or any other appropriate means.

A plurality of longitudinally spaced rigid support rings 32, FIG. 1, and buoyant rings 28 are attached at suitable intervals about the periphery of the lateral segments 20''*a*, 20''*b* and 20''*c* of the sleeve member 20'' for the purposes hereinbefore stated. Attached to the top end of the segment 20''*a* by cement, heat seal, or the like, is a float ring 26 or, as shown in FIG. 5, a float ring 26' having at least two segments 26'*a* and 26'*b*. Likewise, the bottom end of the base segment 20''*b* has attached thereto an anchor ring 22 or 22' and a retriever ring 24 or 24'. The buoyant rings 28 of each lateral segment are shown to be interconnected by flexible pipelines 34 and the buoyant rings in one such segment are interconnected to the buoyant rings of another sleeve segment at 58 by clamps or other appropriate means.

It should be obvious to one having ordinary skill in the art that the three forms of portable well installation apparatus embodying the principles of the present invention described herein have uses other than for surrounding drilling equipment between the water surface and ground about a well head. The principle of the present invention is applicable to control all contaminant seepage originating from the ground beneath a body of water, whether such seepage is the result of a leaky well head, a cracked underground pipe or a leaking fault. It should further be obvious that the dimensions of the apparatus embodying the principles of the invention vary depending upon such factors as the size of the equipment to be surrounded and the depth of the water in which the apparatus is to be used.

Having thus described the present invention by way of examples of structural embodiments thereof, modifications whereof will be apparent to those skilled in the art, what is claimed as new is as follows:

1. A portable off shore well installation apparatus for positioning around drilling equipment between the surface of a body of water and the ground below the water for surrounding a well head to entrap contaminants resulting from drilling operations, said apparatus comprising a curtain having an axially extendable water impermeable sleeve, a submerged ground conforming anchor ring attached at one end of said extendable sleeve, and a float ring for extending said extendable sleeve to the surface of the water attached at the other end of said extendable sleeve, wherein said extendable sleeve has a plurality of longitudinally spaced buoyant rings attached about the periphery thereof to provide lift and rapid substantially uniform extension of said extendable sleeve and said anchor ring is made of a flexible impermeable material which is fillable with a non-buoyant non-rigid substance.

2. The apparatus of claim 1 further comprising a retriever ring secured to the bottom portion of said anchor ring, said retriever ring being constructed of a flexible impermeable material which is fillable with a buoyant substance for controllably decreasing the weight of said anchor ring.

3. The apparatus of claim 2 wherein said extendable sleeve and said anchor ring, float ring, buoyant rings and retriever ring each are formed of a plurality of interconnecting individual segments, and further comprising conduit means placing the interiors of said retriever ring segments in communication with each other.

4. The apparatus of claim 1 wherein said float ring and said buoyant rings are each constructed of a flexible impermeable material wich is fillable with a buoyant substance.

5. The apparatus of claim 4 further comprising conduit means placing the interiors of said buoyant rings in communication with each other.

6. The apparatus of claim 5 further comprising conduit means placing the interior of said float ring in communication with the interiors of said buoyant rings.

7. The apparatus of claim 6 wherein said fillable float ring and buoyant rings each comprise a plurality of interconnecting individual segments including conduit means placing the interiors of said segments in communication with each other.

8. The apparatus of claim 1 wherein said anchor ring further comprises a plurality of interconnecting individual segments.

9. The apparatus of claim 1 wherein said axially extendable water impermeable sleeve is constructed of an accoordion-pleated flexible material.

10. The apparatus of claim 9 further comprising a plurality of longitudinally spaced rigid support rings attached about the periphery of said accordion-pleated sleeve.

11. The apparatus of claim 10 wherein said accordion-pleated sleeve further comprises a plurality of interconnecting individual segments.

12. The apparatus of claim 11 wherein said rigid support rings comprise a plurality of interconnecting individual segments.

* * * * *